United States Patent [19]

Fowler

[11] Patent Number: 4,772,347

[45] Date of Patent: Sep. 20, 1988

[54] PROCESS FOR MAKING FILAMENTARY STRUCTURE

[75] Inventor: Anthony J. Fowler, Coventry, United Kingdom

[73] Assignee: Minnesota Mining and Manufacturing Company, St. Paul, Minn.

[21] Appl. No.: 919,579

[22] Filed: Oct. 15, 1986

Related U.S. Application Data

[60] Continuation of Ser. No. 443,671, Nov. 22, 1982, abandoned, which is a division of Ser. No. 259,960, May 4, 1981, Pat. No. 4,384,022.

[51] Int. Cl.[4] ..... D01D 5/12

[52] U.S. Cl. ..... 156/167; 264/103; 264/143; 264/145; 264/167; 264/177.13; 264/178 R; 264/210.2; 264/210.8; 264/211.12; 264/211.14

[58] Field of Search ..... 425/465; 264/167, 177.13, 264/211.14, 103, 143, 145, 178 R, 210.2, 210.8, 211.12, ; 156/167

[56] References Cited

U.S. PATENT DOCUMENTS

| | | | |
|---|---|---|---|
| 1,685,249 | 9/1928 | Taugi | 425/465 |
| 2,058,551 | 10/1936 | Beattey | 18/8 |
| 2,804,645 | 9/1957 | Wilfong | 18/8 |
| 3,686,049 | 8/1972 | Manner et al. | 156/167 |
| 3,687,759 | 8/1972 | Werner et al. | 156/167 |
| 3,691,004 | 9/1972 | Werner et al. | 161/150 |
| 3,837,988 | 1/1973 | Hennen et al. | 161/67 |
| 3,852,152 | 12/1974 | Werner et al. | 161/168 |
| 4,012,249 | 3/1977 | Stapp | 156/167 |
| 4,017,659 | 4/1977 | Brumlik | 161/172 |
| 4,048,371 | 9/1977 | Brumlik | 428/375 |
| 4,125,666 | 11/1978 | Brumlik | 428/369 |
| 4,332,758 | 6/1982 | Blackmon et al. | 264/177 F |
| 4,562,029 | 12/1985 | Black | 264/167 |

FOREIGN PATENT DOCUMENTS

| | | | |
|---|---|---|---|
| 0007237 | 1/1980 | European Pat. Off. . | |
| 1214193 | 11/1966 | Fed. Rep. of Germany . | |
| 40-9535 | 5/1965 | Japan | 264/177 F |
| 43-5177 | 2/1968 | Japan | 264/177 F |
| 43-22339 | 9/1968 | Japan | 264/177 F |
| 46-36891 | 10/1971 | Japan | 264/167 |
| 2003423 | 3/1979 | United Kingdom . | |
| 1552629 | 9/1979 | United Kingdom . | |

*Primary Examiner*—Jan H. Silbaugh
*Assistant Examiner*—Hubert C. Lorin
*Attorney, Agent, or Firm*—Donald M. Sell; Richard Francis

[57] ABSTRACT

A method of making a filamentary structure comprising a spiral thermoplastic core filament disposed within a thermoplastic sheath component is provided. The method involves extruding together from an extrusion die filaments forming the core filament and the sheath component, with the core filament being extruded at a faster rate than the sheath component which causes the core filament to spiral, and cooling the extrudates to form a unitary structure. A plurality of the filamentary structures may be extruded side-by-side so that their sheath components are joined together to form a fabric structure.

14 Claims, 3 Drawing Sheets

PROCESS FOR MAKING FILAMENTARY STRUCTURE

Figure 1:
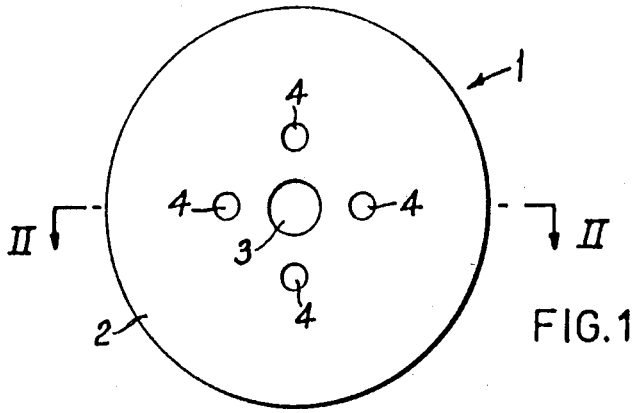

This is a continuation of Ser. No. 443,671, filed 11/22/82, now abandoned, which is a division of application Ser. No. 259,960, filed 5/4/81, now U.S. Pat. No. 4,384,022.

This invention is concerned with the extrusion of thermoplastic polymers to form a novel filamentary structure.

According to the invention, a filamentary structure comprises a spiral thermoplastic core filament disposed within a thermoplastic sheath component which is joined to the succesive turns of the spiral core filament.

The sheath component is preferably a cage formed by at least three thermoplastic filaments each of which is joined to the successive turns of the spiral core filament. Alternatively, the sheath component may comprise a tube.

The invention includes a process for making such a filamentary structure comprising feeding molten thermoplastic polymer to a stationary one-piece extrusion die having an inner jet hole ringed by outer jet holes, extruding the polymer through the inner die hole at a greater velocity than polymer is extruded through the outer die holes to form a spiral extrudate disposed within an extruded sheath component to which its successive turns are adhered, and cooling the extrudates to solidify them to a unitary structure.

The thermoplastic polymer may be any which can be melt spun into filaments including polyamides, polyesters and polyolefins. The polymer extruded through the inner die hole to form the spiral core may be the same as or different from the polymer extruded through the outer die holes to form the sheath component. Preferably it is the same in order to simplify spinning and ensure good adherence between the turns of the spiral core filament and the sheath component.

An elastic filamentary structure may be formed by making the spiral core filament from a non-elastomeric polymer and the sheath component from an elastomeric polymer.

The polymer extruded through the inner die hole is required to have a greater velocity than that flowing through the outer die holes in order that it will take up the desired spiral form. With a common supply of molten polymer, this greater velocity may be achieved by having the inner die hole of greater cross-sectional area and/or of shorter capillary length than each of the outer die holes. Preferably it is of greater cross-sectional area for two reasons: the first being that in the most desirable filamentary structure of the invention the cage filaments which comprise the sheath component are of smaller cross-sectional area than the spiral core filament; and the second being that jets having holes of a common capillary length are much easier to make.

The sizes and cross-sectional shapes of the die holes determine the size and shape of the filaments extruded through them. The preferred shape is circular, particularly for the inner die hole. For a given spacing between the inner die hole and the outer die holes, the pitch of the spiral core filament is determined by the relative polymer velocities through the inner and outer holes. That is, the pitch reduces as the velocity differential increases.

Preferably, the axes of the inner and outer die holes are all parallel to one another so that, in the embodiment where the sheath component comprises a cage of filaments, these filaments are in substantially parallel alignment with the axis of the spiral core filament.

The diameter of the spiral of the core filament is determined by the sheath component which holds it in place and which stabilises it by adhering to its successive turns. When the sheath component comprises a cage of filaments it has been found that it is necessary to have at least three cage filaments for this purpose otherwise the core filament 'breaks out' and is uncontrolled. Preferably each cage filament is spaced apart from its adjacent cage filaments by substantially equal distances. This may be arranged by using a spinning jet with a central inner jet hole ringed by at least three outer die holes pitched at substantially equal angles to and substantially equidistant from the central inner die hole.

The number of cage filaments can be increased to any desired number commensurate with the dictates of jet geometry. In the limit, each outer die hole is positioned sufficiently closely to its adjacent outer die holes that because of die swell the extruded cage filaments merge to form a tube. The outer die holes are preferably of circular cross-section, although other suitable cross-sections may be used, for example arcuate slots which may be used to produce a tube as described.

The extruded structure may be cooled in air to solidify it, but it is preferred to stabilise it more quickly by quenching it in a liquid bath which is conveniently water.

The filamentary structure of the invention may be used as yarn, core or twine, or as a reinforcement for a tube. In the embodiments described where the sheath component comprises a tube, it constitutes a reinforced tube itself. It may also be used to construct an abrasive pad such as a pan scrub.

The invention includes a fabric structure comprising a plurality of filamentary structures according to the invention joined to each other with the axes of the spiral filaments in substantially parallel relation. This fabric structure may be produced directly by extrusion using a bank of adjacent sets of die holes from which adjacent filament structures are extruded. These merge and become adhered so that after being cooled to solidify them, they remain joined as a unitary fabric structure. The component filamentary structures may be arranged in a planar array by a corresponding arrangement of the adjacent sets of die holes, to produce a planar fabric structure. Three-dimensional fabric structures may be made using appropriate groupings of the sets of die holes from which the component filamentary structures are extruded.

The fabric structure of the invention has a variety of uses including use as drainage, earth-support and other civil engineering fabrics, and as matting such as door mats.

In the embodiment of the invention where the sheath component comprises a cage of filaments, limited stretching of the filamentary structure produces elongation of the cage filaments between the successive points of adherence, with the result that after removal of the stretching forces and contraction of the spiral core, the cage filaments balloon out between the adherence points giving an expanded structure.

Greater stretching causes the cage filaments to break between the points where they are joined to the spiral core filament, close to those points, to produce a modified filamentary structure which is a further aspect of the invention. The broken cage filaments constitute fibrils which are substantially uniform in length, with the majority of the fibrils being raked in a common direction.

The modified filamentary structure has decorative qualities and may be used as fancy yarn, or twine, especially if coloured. The rake of the fibrils gives it a particularly distinctive appearance and also imparts good knot-tying properties. The roughness of the fibrils, particularly at the adherence points, gives the product abrasive properties making it suitable for the construction of scouring pads, for example.

Figure 2:
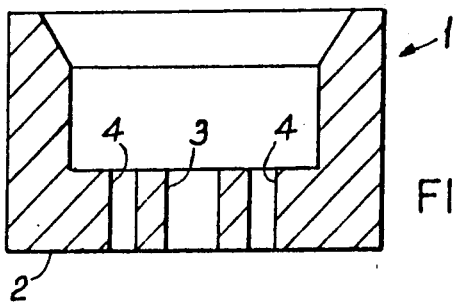
Figure 5:
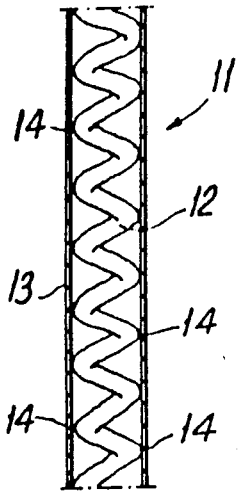
Figure 6:
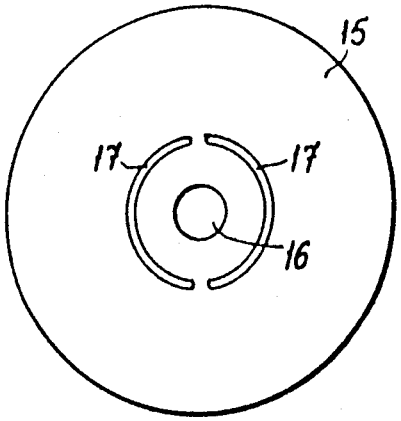
Figure 7:
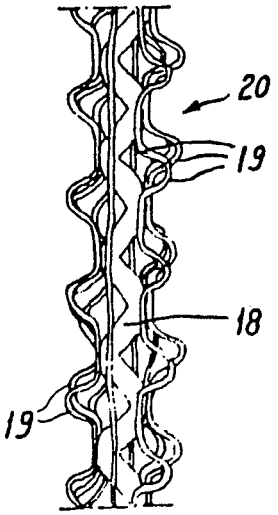
Figure 8:
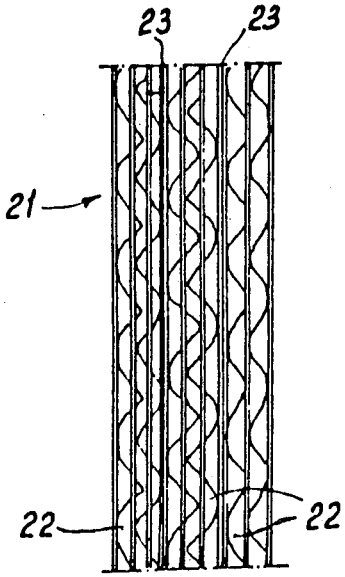
Figure 9:
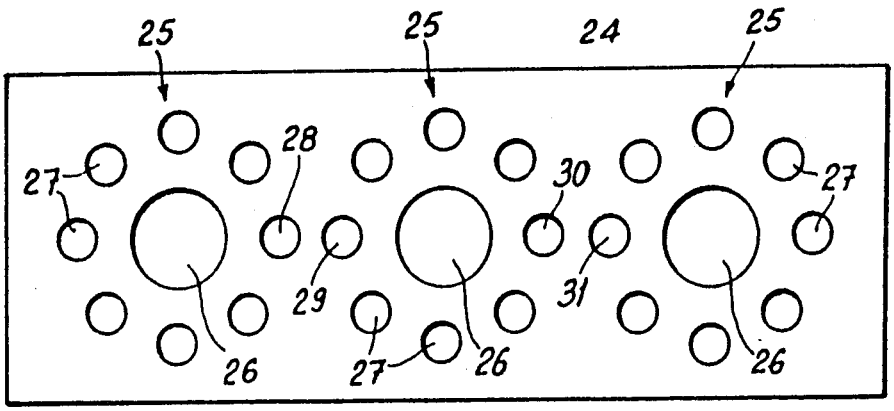
Figure 10:
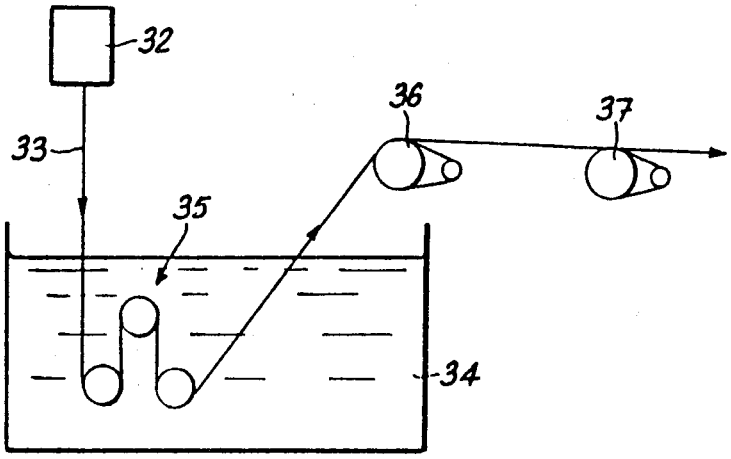

The invention is illustrated by the accompanying drawings in which:

FIG. 1 is a plan of the face of a one-piece stationary extrusion die suitable for use in the process of the invention, FIG. 2 is a cross-section on the line II . . . II of FIG. 1, FIG. 3 is an elevation of a filamentary structure in accordance with the invention, FIG. 4 is an elevation of a modified filamentary structure formed by stretching the structure of FIG. 3, FIG. 5 is a sectional elevation of another filamentary structure in accordance with the invention, FIG. 6 is a plan, on an enlarged scale, of the face of an extrusion die suitable for spinning the filamentary structure shown in FIG. 5, FIG. 7 is an elevation of the structure of FIG. 3 after being partially stretched, FIG. 8 is an elevation of a fabric structure in accordance with the invention, FIG. 9 is a plan, on an enlarged scale, of the face of a die suitable for spinning the fabric structure shown in FIG. 8, and FIG. 10 is a diagram of apparatus for spinning a filamentary structure in accordance with the invention.

Referring to FIGS. 1 and 2, a spinning jet 1 has a circular die face 2 in which are drilled an inner die hole 3 encircled by a ring of four outer die holes 4. The die holes have the same capillary length and the inner die hole is shown as about twice the diameter of the outer die holes.

Figure 3:
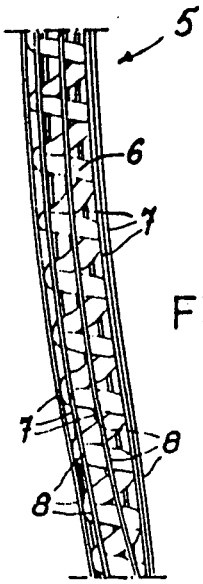

FIG. 3 shows a filamentary structure 5 spun from a die similar to that shown in FIGS. 1 and 2, but comprising eight outer die holes instead of four. The filamentary structure 5 comprises a spiral core filament 6 held within a cage of eight finer filaments 7 which are joined to the successive turns of the spiral core filament at points 8.

Figure 4:
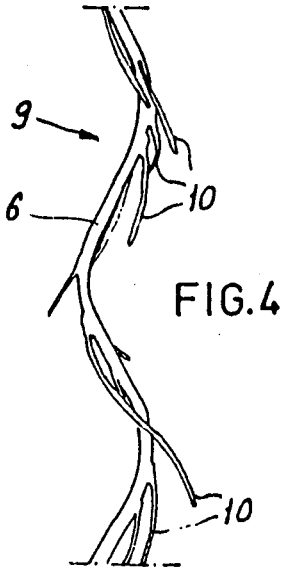

FIG. 4 shows a modified filamentary structure 9 produced by stretching the structure 5, whereby the cage filaments 7 have broken close to the points 8. The resulting fibrils 10 are regularly spaced and uniform in length. As shown they are raked in a common direction. The points at which they are joined to the core filament 6 lie on a generally spiral path around the core filament.

The filamentary structure 11 shown in FIG. 5 comprises a spiral core filament 12 held within a tubular sheath 13 which is joined to the successive turns of the spiral core filament at points 14. The structure 11 may be spun from a die of the type shown in FIG. 6 in which the die 15 has a central inner die hole 16 ringed by two outer die holes 17 in the form of two arcuate slots. The extrudates from the outer die holes merge below the die to form a tube enclosing the spiral core filament formed from the higher velocity extrudate from the inner die hole.

FIG. 7 shows a filamentary structure of the type shown in FIG. 3 after being stretched to a degree which elongates the cage filaments without breaking them. On being allowed to relax, the spiral core filament 18 contracts and causes the elongated cage filaments 19 to balloon out as shown to produce an expanded filamentary structure 20.

The fabric structure 21 shown in FIG. 8 comprises three filamentary structures of the type shown in FIG. 3 with the axes of their spiral core filaments 22 parallel and adjacent cage filaments 23 fused together. This fabric structure may be produced by a die of the type shown in FIG. 9 which has a rectangular die face 24 with three sets 25 of die holes lying adjacent to each other in a line. Each set 25 comprises an inner die hole 26 ringed by eight outer die holes 27 of smaller diameter. The cage filaments extruded from the adjacent pairs of outer die holes 28, 29 and 30, 31, respectively, merge below the jet face to join the extruded filamentary structures together as a fabric.

The number of sets of die holes may be extended beyond three to produce wider fabric structures, and may also be grouped other than in line, for example as a grid, to provide three-dimensional fabric structures.

In FIG. 10, the apparatus shown diagrammatically comprises an extrusion die 32 from which a filamentary structure 33 according to the invention is extruded downwardly into a water quench bath 34. The solidified structure is withdrawn from the die by driven rollers 35 is a 'clover leaf' formation and located below the surface of the bath. The structure is withdrawn from the bath by a godet 36 and, if desired, stretched between the godet 36 and a further godet 37 to produce a structure as shown in FIG. 4 or FIG. 6 depending upon the degree of stretch.

The invention is illustrated by the following Examples:

Examples 1 to 6

Nylon 6 polymer was melted and extruded through various spinning jets as shown in FIGS. 1 and 2 of the drawings, some with four outer die holes and some with eight outer jet holes with variations also in the pitch circle diameter (PCD) of the outer die holes. The extrudates were quenched in a water bath at room temperature and collected either by free fall or by nip rollers. Samples were taken and stretched at two different percentage stretches, one simply to bulk the product and the other a greater stretch to break the cage filaments and produce the modified filamentary structure.

The following die dimensions and process conditions were common to all six Examples. Other conditions which varied between Examples and the product properties are shown in the succeeding Table.

TABLE

| | |
|---|---|
| Inner die hole diameter | 350 μm |
| Outer die hole diameter | 175 μm |
| Capillary length of all die holes | 437 μm |
| Head temperature of die | 260° C. |
| Polymer throughput | 13.46 g/min. |

| Example | 1 | 2 | 3 | 4 | 5 | 6 |
|---|---|---|---|---|---|---|
| Number of outer die holes | 8 | 8 | 4 | 4 | 8 | 8 |
| PCD of outer die holes (μm) | 844 | 844 | 900 | 900 | 1000 | 1000 |
| Distance from die face to quench bath (cm) | 1.5 | 10 | 1.5 | 10 | 1.5 | 10 |
| Take-up speed | 13.3 | Free | 17.7 | Free | 12 | Free |

TABLE-continued

| | |
|---|---|
| Inner die hole diameter | 350 μm |
| Outer die hole diameter | 175 μm |
| Capillary length of all die holes | 437 μm |
| Head temperature of die | 260° C. |
| Polymer throughput | 13.46 g/min. |

| Example | 1 | 2 | 3 | 4 | 5 | 6 |
|---|---|---|---|---|---|---|
| m/min | | Fall | | Fall | | Fall |
| Diameter of extrudate (cm) | 0.18 | 0.21 | 0.20 | 0.25 | 0.21 | 0.23 |
| Diameter of spiral core filament (cm) | 0.07 | 0.07 | 0.07 | 0.07 | 0.07 | 0.07 |
| Pitch of spiral (cm) | 0.21 | 0.17 | 0.31 | 0.30 | 0.22 | 0.21 |
| Direction of spiral (cw or acw)* | acw | acw | cw | acw | cw | cw |
| Diameter of cage filaments (cm) | 0.02 | 0.025 to 0.030 | 0.02 | 0.020 to 0.028 | 0.025 | 0.025 |
| Weight/unit length of extrudate (g/m) | 0.973 | 1.311 | 0.760 | 0.886 | 1.210 | 1.260 |
| Stretch to bulk (percent) | 120 | 130 | 100 | 110 | 130 | 120 |
| Stretch to break (percent) | 425 | 400 | 500 | 520 | 420 | 410 |
| Percentage of fibrils raked | | | | | | |
| towards die | 95 | 70 | 95 | 95 | 90 | 95 |
| away from die | 5 | 30 | 5 | 5 | 10 | 5 |

*cw = clockwise
acw = anticlockwise

What is claimed is:

1. A process for making a filamentary structure comprising feeding molten thermoplastic polymer to a stationary one-piece extrusion die having an inner die hole ringed by at least three outer die holes in which each outer die hole is positioned sufficiently closely to its adjacent outer die holes such that extrudates from the outer die holes merge to form a tubular sheath component, extruding the polymer though the inner die hole at a greater velocity than polymer is extruded through the outer die holes to form a spiral extrudate disposed within an extruded tubular sheath component to which successive turns of said spiral extrudate are adhered, and cooling the extrudates while maintaining the spiral to solidify them to a unitary structure comprising a spiral thermoplastic core filament disposed within a thermoplastic tubular sheath component joined at said successive turns of said spiral core filament.

2. A process as claimed in claim 1, in which said outer die holes are pitched at substantially equal angles to and substantially equidistant from the inner die hole.

3. A process as claimed in claim 1 or claim 2, in which each of the outer die holes of said extrusion dies is of smaller cross-sectional area than the inner die hole.

4. A process as claimed in claim 1 or 2, in which the inner die hole or the outer die holes or both the inner and outer die holes are of substantially circular cross-section.

5. A process as claimed in claim 1 or claim 2, in which the extrudates are cooled by passing them into a liquid quench bath.

6. A process for making a filamentary structure comprising feeding molten thermoplastic polymer to a stationary one-piece extrusion die having an inner die hole ringed by outer die holes in which said outer die holes comprise arcuate slots from which a tubular sheath component can be extruded, extruding the polymer through the inner die hole at a greater velocity than polymer is extruded through the outer die holes to form a spiral extrudate disposed within an extruded tubular sheath component to which successive turns of said spiral extrudate are adhered, and cooling the extrudates while maintaining the spiral to solidify them to a unitary structure comprising a spiral thermoplastic core filament disposed within a thermoplastic tubular sheath component which is joined at said successive turns of said spiral core filament.

7. A process for making a filamentary structure comprising feeding molten thermoplastic polymer to a stationary one-piece extrusion die having an inner die hole ringed by at least three outer die holes, extruding the polymer through the inner die hole at a greater velocity than polymer is extruded through the outer die holes to form a spiral extrudate disposed within an extruded sheath component to which successive turns of said spiral extrudate are adhered, cooling the extrudates while maintaining the spiral to solidify them to a unitary structure comprising a spiral thermoplastic core filament disposed within a thermoplastic sheath component which is joined at said successive turns of said spiral core filament, stretching said unitary structure, and then allowing the stretched unitary structure to relax to cause the sheath component which comprises filaments to balloon out between the points where it is joined to said spiral core filament and to thereby give an expanded structure.

8. A process according to claim 7 in which said extrusion die has a central inner die hole ringed by at least three outer die holes pitched at substantially equal angles to and substantially equidistant from the central inner die hole.

9. A process for making a filamentary structure comprising feeding molten thermoplastic polymer to a stationary one-piece extrusion die having an inner die hole ringed by at least three outer die holes, extruding the polymer through the inner die hole at a greater velocity than polymer is extruded through the outer die holes to form a spiral extrudate disposed within an extruded sheath component to which successive turns of said spiral extrudate are adhered, cooling the extrudates while maintaining the spiral to solidify them to a unitary structure comprising a spiral thermoplastic core filament disposed within a thermoplastic sheath component which is joined at said successive turns of said spiral core filament, and stretching said unitary structure to the extent that the sheath component breaks between the points where it is joined to said spiral core filament to produce a filamentary structure in which the sheath component comprises broken filaments which constitute fibrils substantially uniform in length, the majority of which being raked in a common direction.

10. A process according to claim 9 wherein said extrusion die has a central inner die hole ringed by at least three outer die holes pitched at substantially equal angles to and substantially equidistant from the central inner die hole.

11. A process for making a fabric structure comprising feeding molten thermoplastic polymer to a plurality of adjacent stationary one-piece extrusion dies each die having an inner die hole ringed by outer die holes, extruding the polymer through each inner die hole at a greater velocity than polymer is extruded through the outer die holes to form a plurality of adjacent spiral extrudates each disposed within an extruded sheath component to which successive turns of each of said spiral extrudates are adhered, and cooling the extrudates while maintaining the spirals to solidify them to a unitary fabric structure comprising a plurality of filamentary structures comprising a plurality of adjacent spiral thermoplastic core filaments each disposed within a thermoplastic sheath component which is joined at said successive turns of each of said spiral core filaments in which said plurality of filamentary structures are extruded adjacent to each other with axes of the spiral core filaments substantially parallel whereby the extruded filamentary structures adhere to each other and after being cooled to solidify them are joined as a unitary fabric structure.

12. A process according to claim 11 in which said extrusion die has at least three outer die holes.

13. A process according to claim 11 in which said extrusion die has a central inner die hole ringed by at least three outer die holes pitched at substantially equal angles to and substantially equidistant from the central inner die hole.

14. A process for making a fabric structure by a process as claimed in claim 11, claim 12 or claim 13, in which said plurality of filamentary structures are extruded adjacent to each other as a planar array with axes of the spiral core filaments substantially parallel whereby the extruded filamentary structures adhere to each other and after being cooled to solidify them remain joined as a unitary planar fabric structure.

* * * * *